United States Patent [19]

Godec et al.

[11] 4,427,223

[45] Jan. 24, 1984

[54] LATCHING DEVICE

[75] Inventors: Maksimilijan Godec; John R. Foster; Paul J. Straub, all of Indianapolis; Allan K. Mahler, Terre Haute, all of Ind.

[73] Assignee: Von Duprin, Inc., Indianapolis, Ind.

[21] Appl. No.: 289,757

[22] Filed: Aug. 3, 1981

[51] Int. Cl.[3] ..... E05C 15/02; E05B 55/04

[52] U.S. Cl. ..... 292/92; 70/134; 70/467; 70/477; 70/478; 292/244; 292/DIG. 27

[58] Field of Search ..... 70/129, 134, 467, 470, 70/473, 475, 477, 478, 483, 489; 292/244, 350, 92, DIG. 27

[56] References Cited

U.S. PATENT DOCUMENTS

| | | | |
|---|---|---|---|
| 1,062,176 | 5/1913 | Mason | 70/467 |
| 1,512,986 | 10/1924 | Hurd | 70/146 X |
| 2,106,951 | 2/1938 | Hubbell | 292/DIG. 27 X |

FOREIGN PATENT DOCUMENTS

| | | | |
|---|---|---|---|
| 239081 | 6/1962 | Australia | 70/129 |
| 2517330 | 11/1975 | Fed. Rep. of Germany | 70/134 |
| 500628 | 11/1954 | Italy | 70/129 |
| 1130040 | 10/1968 | United Kingdom | 70/129 |
| 2039585 | 8/1980 | United Kingdom | 70/478 |

*Primary Examiner*—Gary L. Smith

*Assistant Examiner*—R. Illich

*Attorney, Agent, or Firm*—B. J. Murphy

[57] ABSTRACT

The device comprises a latching assembly enclosed within, and translatable relative to, a centercase housing; the housing is mounted on a chassis. The device is adapted for cooperative engagement with a locking cylinder, for actuating the latching assembly, and for operation of a thumbpiece lift, by an ancillary, external, trim linkage, for translating the latching assembly. The latching device has a master, locking cylinder cam or dowel, the latter having a removable screw, which (through a locking cylinder) either operates a night-latch cam plate, to translate the latching assembly or, upon removal of the screw, allows the cam or dowel to translate a tumbler which, in turn, frees a thumbpiece lift, for operation (then) of the latching assembly by the lift, instead of by the cam plate. Accordingly, with the drive screw in place, the external, operating trim linkage can not operate the device; it must be unlatched, externally, by a key in the locking cylinder. With the drive screw removed, the use of a key in the locking cylinder will not unlatch the device, rather, in this circumstance, key-operation of the locking cylinder will enable the external trim linkage to unlatch the device, and such key-operation (with the drive screw removed) will also disable the trim linkage operation of the device, selectively.

12 Claims, 8 Drawing Figures

FIG. 1
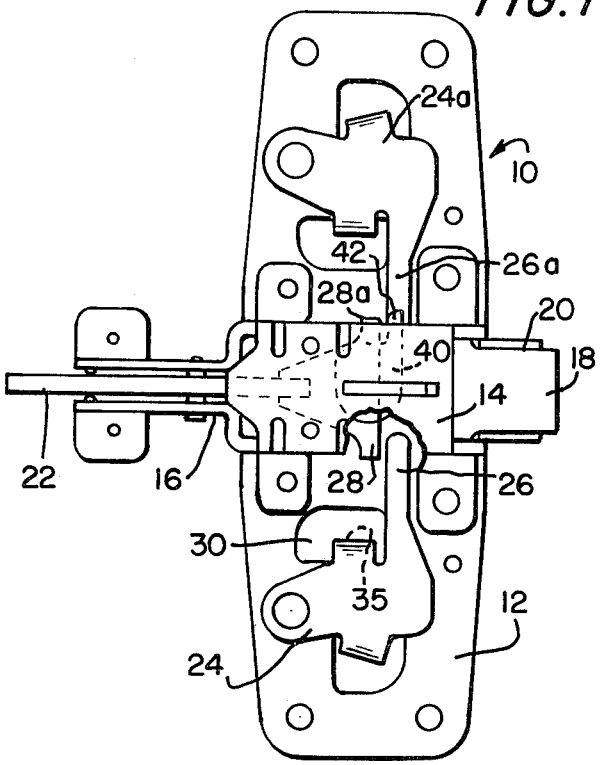
FIG. 2
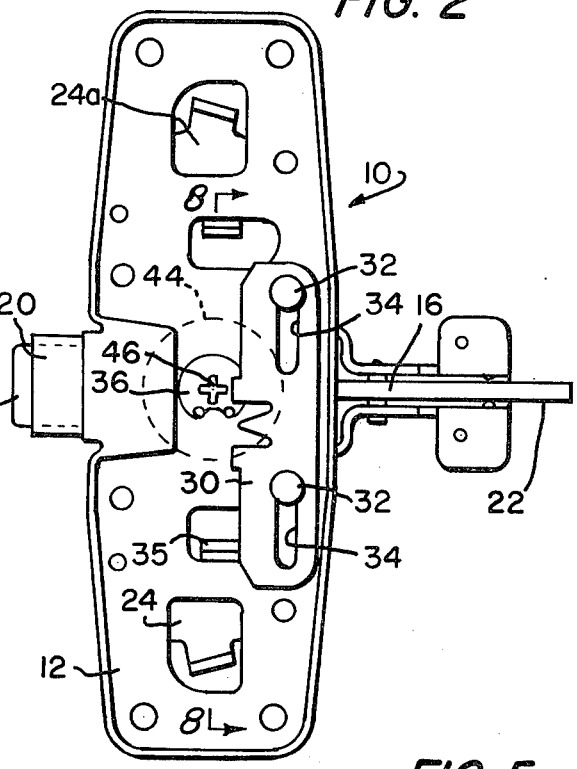
FIG. 3
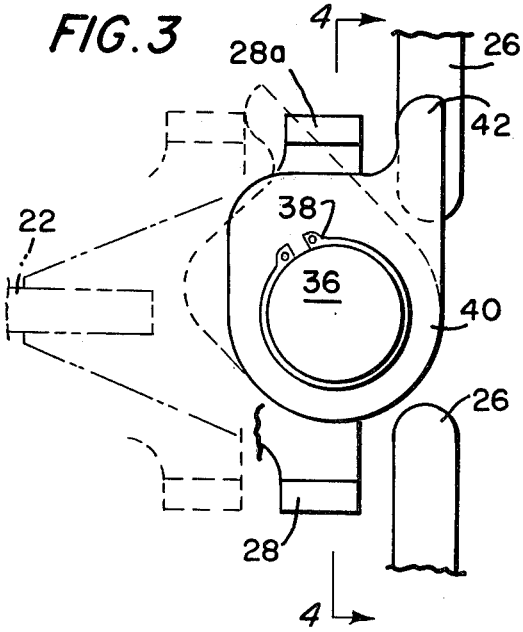
FIG. 6
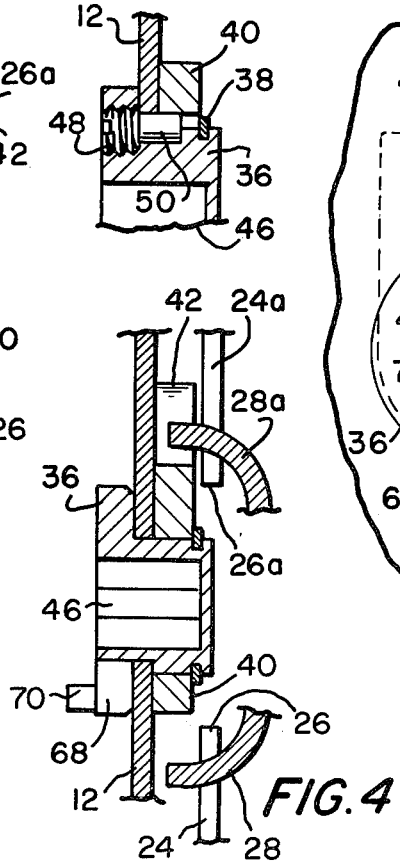
FIG. 4
FIG. 5
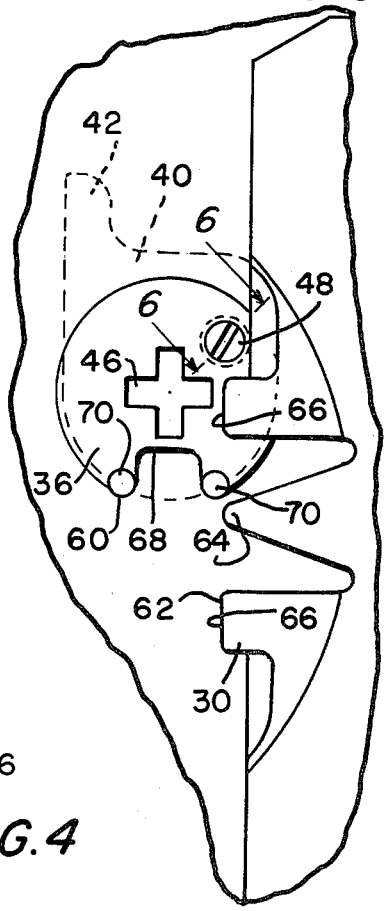

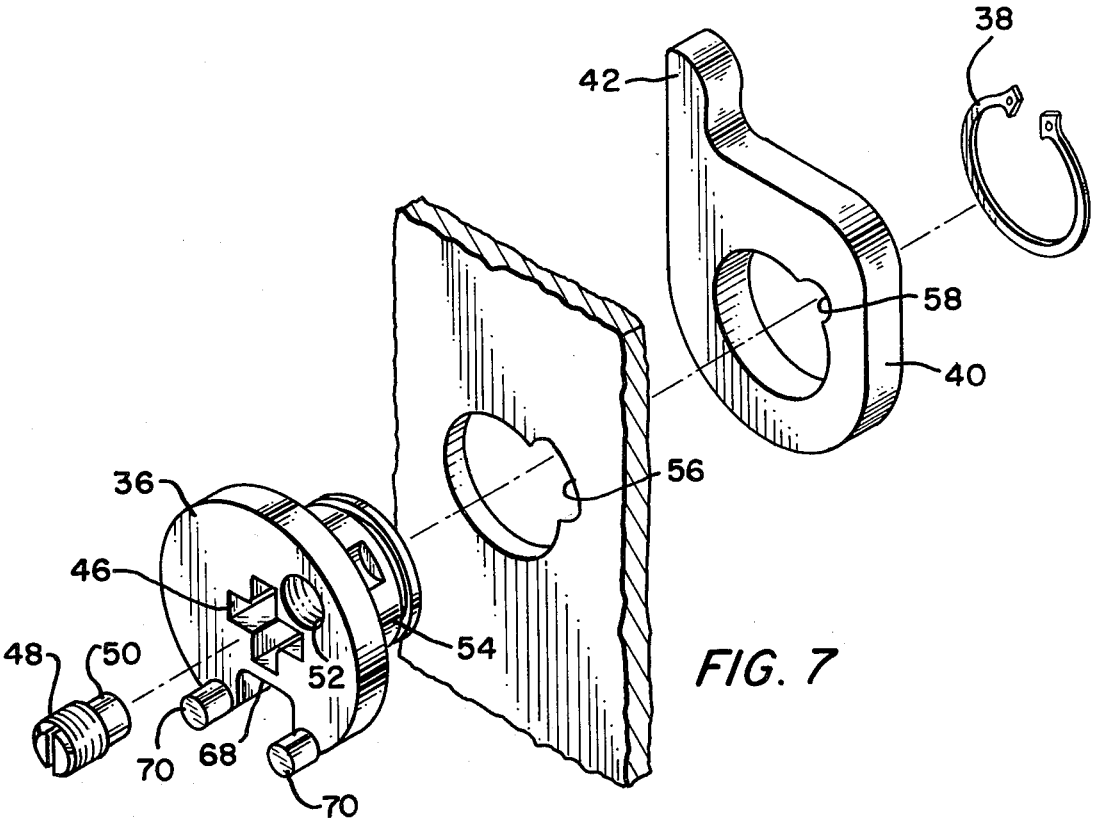
FIG. 7
FIG. 8
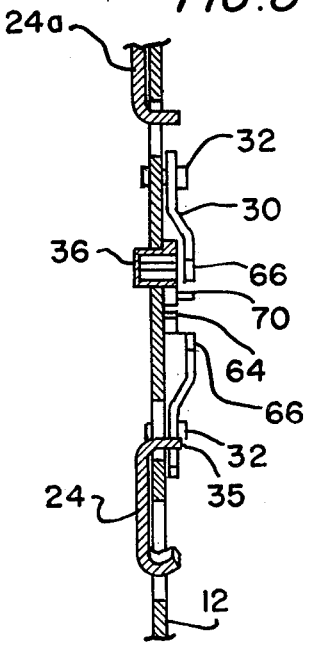

LATCHING DEVICE

This invention pertains to latching devices for doors and the like, typically for those of the panic-exit type and, in particular, to a novel and universal latching device which is easily modified to enable a key-operated master cylinder to operate the latching device or to enable the master cylinder to release or lock-up a trim input system which may, for example, comprise a thumbpiece (or a like, external, manipulative element).

In the prior art, typical latching devices use a trim cylinder, i.e., a key-operated master cylinder, to retract the latching assembly thereof, or they employ such a cylinder to engage and disengage, that is, lock-up or release a normal trim input system having a manipulative thumbpiece, or the like, which, in turn, is operative of the latching assembly. When it is desired, to change from one such operation or functioning to the other, a replacement latching device must be provided, or the latching device must be considerably modified. In the latter circumstance, parts need to be replaced and/or substituted, at considerable expense, and invariably the somewhat complicated modification involves the risk of misassembly. What has been needed is a universal latching device having the aforesaid alternative functions which accommodates a simple modification in the field to render it convertible from one use or function to the other, alternatively, as desired.

It is an object of this invention to provide such a needed latching device. It is also an object of this invention to provide a latching device, comprising: a chassis; a frame having an axis, coupled to said chassis; a latching assembly, having a latch, coupled to and movable axially of said frame (a) for retracting said latch inwardly, i.e. toward said frame, upon movement of said assembly in a first, axial direction, and (b) for extending said latch outwardly, i.e. away from said frame, upon assembly movement in a second, opposite, axial direction; said assembly having actuating means operative for causing axial movement of said latching assembly; first means coupled to said chassis, and engageable with said actuating means, for operating said actuating means to cause axial movement of said latching assembly; second means coupled to said chassis for movement relative to said chassis, to first and second dispositions, for prohibiting operating engagement of said first means with said actuating means, upon said second means being in one of said first and second dispositions; and third means, having a plurality of operative modes, coupled to said chassis for movement relative thereto, (a) for operating said actuating means, in a first of said operative modes, and (b) for moving said second means from one of said first and second dispositions to the other thereof, in a second of said operative modes.

It is further an object of this invention to provide a latching device, comprising: a latching assembly; and means, having an axis, for supporting said latching assembly; wherein said latching assembly has an extensible and retractable latch, and said assembly is coupled to, and movable axially of said supporting means (a) for retracting said latch inwardly, i.e. toward said supporting means, upon movement of said assembly in a first, axial direction, and (b) for extending said latch outwardly, i.e. away from said supporting means, upon assembly movement in a second, opposite, axial direction; said assembly having actuating means manipulative for causing axial movement of said latching assembly; first and second means, coupled to said supporting means, and engageable with said manipulative means for manipulating the latter to cause axial movement of said latching assembly; and third means coupled to said supporting means for movement, relative to the latter, to first and second dispositions, for prohibiting manipulative engagement of one of said first and second means with said manipulative means, upon said third means being in one of said first and second dispositions; wherein the other of said first and second means comprises means operative for moving said third means (a) from said one disposition to the other thereof, and (b) from said other disposition to said one disposition.

Further objects of this invention as well as the novel features thereof will become more apparent by reference to the following description taken in conjunction with the accompanying figures in which:

FIG. 1 is a front, elevational view of the novel latching device, according to an embodiment thereof, in which the trim covers, for the housing or frame, and chassis, have been omitted for purposes of clarity;

FIG. 2 is a bottom, elevational view of the figure 1 embodiment;

FIG. 3 is an enlarged detail, and elevational view, showing the cooperation between a thumbpiece lift, a main control link wing, and the master cylinder cam or dowel;

FIG. 4 is a cross-sectional view taken along section 4—4 of FIG. 3;

FIG. 5 is an enlarged detail showing the cooperation between the master cylinder cam or dowel and the trim lock tumbler;

FIG. 6 is a cross-sectional view taken along sections 6—6 of FIG. 5;

FIG. 7 is an isometric, exploded view illustrative of the cooperation between the cam plate, the cylinder cam or dowel, and the replaceable drive screw therefor; and FIG. 8 is a cross-sectional view taken along section 8—8 of FIG. 2.

As shown in the figures, the latching device 10 according to an embodiment thereof, comprises a chassis 12, to which is replaceably mounted a centercase housing or frame 14. The frame slidably receives and mounts a latching assembly 16 having a latch 18 and an auxiliary latch bolt 20. Linkage joining the latch 18 and the auxiliary latch bolt 20 to an operating, main control link 22, and spring biasing of the latch 18 and latch bolt 20 to an outward or latched disposition, is of only peripheral importance to the instant invention; disclosure of the link 22 to latch 18 and auxiliary latch bolt 20 cooperative coupling and functioning, and the spring biasing of the latching assembly 16, is set forth in a companion patent application, Ser. No. 289,758, filed Aug. 3, 1981, by M. Godec et al., for a Non-Handed, Gravity-Operated, Deadlocking Device. Accordingly such disclosure, on the cooperation between the main control link 22 and the latch 18, etc., for causing retraction and extension of the latch is not repeated here; it is not essential to an understanding of the invention. As described thus far, the latching assembly 16 conforms to such devices as are well known in the prior art. Such a latching assembly, for example, is marketed as a "99 Rim Device" by Von Duprin, Inc., of 400 West Maryland, Indianapolis, Ind. 46225. The instant invention comprises the modification of such known devices by the incorporation therein of a trim lock tumbler onto a chassis for the locking assembly, and the operative journalling, in the chassis, of a master cylinder cam or dowel. The functionings thereof are set out in the ensuing text.

Pivotably coupled to the chassis 12, at opposite ends thereof, are thumbpiece lifts 24 and 24*a*. The one shown at the top of FIG. 1, i.e. 24*a*, is a "right-hand" lift, and the one toward the bottom, i.e. 24, is a "left-hand" lift. The latching device shown comprises, by way of example, a "left-hand" latching device 10, that is, one for use on a left-hand door. By simple, end-for-end rotation, however, it becomes usable on a right-hand door. The lift 24 is engageable by an external, operating thumbpiece (not shown) to cause it to pivot. The left-hand thumbpiece lift 24 is pivoted to the chassis 12 in order that the extending limb 26 thereof can swing or slue and engage the left-hand wing 28 of the main control link. The left-hand wing 28, and the right-hand wing 28*a*, are integral with the link 22. Thus, causing either of the latter to move to the left (in FIG. 1) will move the link 22 in the same direction, and will retract the latch 18 and the auxiliary latch bolt 20. This will occur, of course, if the thumbpiece lift 24 is not obstructed and prevented from pivoting. However, as shown in FIG. 2, the thumbpiece lift 24 is obstructed by a trim lock tumbler 30. The tumbler 30 is an elongate element slidably mounted to the underside of the chassis 12 by means of guide bolts 32 which fit in a pair of slots 34. A lower end of the tumbler 30 engages a tab 35, of the lift 24, which projects through an aperture in the chassis 12. With the tumbler 30 obstructing the tab 35, the lift 24 cannot engage the left-hand wing 28 and retract the latching assembly. Accordingly, the external, trim thumbpiece (not shown) is unable to unlatch the device 10. The invention comprises means for moving the tumbler 30 out of obstruction of the lift 24, and this will be discussed subsequently.

Mounted centrally within the chassis 12, and rotatably therein, is a master cylinder cam or dowel 36. The dowel 36 is journalled in the chassis 12 and, by means of a snap ring 38, retains a cam plate 40 thereon. The plate 40 has an extended limb 42 so that, with rotation of the dowel 36, the limb 42 will slue through a limited arc, provided that the plate 40 is keyed to the dowel 36. FIG. 3, in solid, and in dashed outline, depicts the limited, arcuate slue of the limb 42 and, as can be appreciated, the limb 42 is engageable with the right-hand wing 28*a*. It is, therefore, operative of the latching assembly 16. By this means, then, a cylinder lock 44 (shown in phantom in FIG. 2), having an extending operative, bladed element, or the like (not shown), will engage the cruciform recess 46 formed in the cam or dowel 36 and turn the dowel through the limited arc. A key used in such a cylinder lock 44, therefore, will operate the latching device 10 in the aforesaid manner.

As stated, the cam plate 40 and limb 42 will slue through a limited arc if the plate 40 is keyed to the dowel 36. Such keying is provided by means of a drive screw 48 which has a leading, unthreaded shank 50. The screw 48 is fastened in a threaded bore 52 formed in the dowel 36, and a portion of the shank 50 protrudes from the wall of a reduced portion 54 of the dowel 36. The protruding shank portion is received in an arcuate cut-out 56 formed therefor in the chassis 12, and nests in a semi-circular, walled void 58 formed therefor in the cam plate 40. The cut-out 56 restricts the rotation of the dowel 36 and cam plate 40 to the limited arc priorly mentioned, and the void 58 causes the cam plate 40 to rotate in common with the dowel 36.

If the drive screw 48 is withdrawn, i.e., removed from the dowel 36, the cam plate 40 will not rotate; rather, with the drive screw 48 removed, and the cylinder lock 44 rotated (by means of a key), the dowel 36 will rotate independently of the cam plate 40, and is free to rotate through a greater arc. The dowel 36 has a gear type edge 60 which is engageable with a toothed edge 62 formed on the trim lock tumbler 30. Again, by using the key cylinder lock 44, and rotating the dowel 36, the gear-type edge 60 will engage the toothed edge 62 and displace the tumbler 30 slidably upwardly (FIGS. 2 and 5) to where it no longer interferes with the left-hand thumbpiece lift 24. Now, the normal, external, thumbpiece trim (not shown) will be able to operate the thumbpiece lift 24. The limb 26 can slue, and translate the wing 28, and retract the latching assembly 16.

As seen in FIG. 8, the tumbler 30 has an intermediate, tapered tooth 64 which, unless driven by the dowel 36, will not allow the tumbler to move out of obstruction of the lift 24. The tumbler 30 also has two blunt teeth 66, on opposite sides of tooth 64, which are slightly elevated from the chassis 12. Now, with the drive screw 48 in position, the dowel 36 rotates through the aforesaid limited arc, defined by the length of the cut-out 56, and the tooth 64 can not slide past the dowel. With the drive screw 48 removed, however, the edge 60 is free to engage the edge 62. Edge 60 has a recess 68 in which to receive the tooth 64, and a pair of upstanding stubs 70 for drivingly engaging the teeth 66. Accordingly, the cylinder lock 44 can be used to slide the tumbler 30 out of obstruction of the lift 24, or it can be used to move the tumbler into such obstruction. Rotation of the dowel 36 in a counterclockwise direction (FIGS. 2 and 5), with the drive screw 48 removed therefrom, causes the edges 60 and 62 to mesh, and the tumbler 30 to slide upwardly (relative to FIG. 2 disposition thereof) to end its obstruction of tab 35. Now, the tumbler 30 will remain in the upward disposition unless the dowel 36 is turned in a clockwise direction. Upon the latter being done, the tumbler 30 will return to the tab-obstructing disposition (of FIG. 2). The reason for the tumbler 30 remaining in an upward, unobstructing position, or downward in an obstructing position is due to the tooth 64 (priorly noted). Unless the dowel 36 is rotated, to pass the tooth 64 through the recess 68, the tumbler can not negotiate past the dowel. The drive screw 48, then, is the only component to be used, or not used, to enable the device 10 to perform all of its functions. Therefore, to change the latching device 10 from only key operation, or to key and thumbpiece lift operation, and back again, it is only necessary either to use or to remove the drive screw 48.

While we have described our invention in connection with specific embodiments thereof, it is to be clearly understood that this is done only by way of example, and not as a limitation to the scope of our invention as set forth in the objects thereof, and in the appended claims.

We claim:

1. A latching device, comprising:

a chassis;

a housing, having an axis, coupled to said chassis;

a latching assembly, having a latch, coupled to and movable axially of said housing (a) for retracting said latch inwardly, i.e. toward said housing, upon movement of said assembly in a first, axial direction, and (b) for extending said latch outwardly, i.e.

away from said housing, upon assembly movement in a second, opposite, axial direction;

said assembly having wing means extending therefrom for engagement thereof by other means to cause axial movement of said latching assembly;

limb means pivotably coupled to said chassis, and engageable with said wing means to cause axial movement of said latching assembly;

tumbler means coupled to said chassis for movement relative to said chassis, to first and second dispositions, for prohibiting operating engagement of said limb means with said wing means, upon said tumbler means being in one of said first and second dispositions; and camming means coupled to said chassis for movement relative thereto for moving said tumbler means from either one of said first and second dispositions to the other thereof; wherein said wing means extends from said latching assembly into immediate adjacency to said chassis;

said limb means comprises a limb pivotably coupled to said chassis for sluing movement thereof into operating engagement with said wing means; and said tumbler means comprises means for obstructing said limb and preventing sluing movement thereof.

2. A latching device, according to claim 1, wherein:

said tumbler and camming means have coactive gear means cooperative for moving said tumbler means to and from said one disposition.

3. A latching device, according to claim 1, wherein:

said tumbler means comprises an element slidably coupled to said chassis for movement, to said first and second dispositions, transverse to said axis; and said camming means comprises means for obstructing said tumbler means and preventing slidable movement thereof.

4. A latching device, according to claim 1, wherein:

said chassis is of elongate configuration;

said limb means comprises a pair of limbs pivotably coupled to said chassis, at either ends of said chassis, for sluing movement thereof into operating engagement with said wing means.

5. A latching device, according to claim 4, wherein:

said tumbler means comprises means for obstructing either limb of said pair, and preventing sluing movement of said either limb.

6. A latching device, according to claim 1, wherein:

said camming means is rotatably coupled to said chassis; and said camming means cooperative with said chassis to limit rotation thereof to an arc.

7. A latching device, according to claim 1, wherein:

said camming means comprises a dowel rotatably journalled in said chassis; and a cam plate, having an extended limb, pivotably coupled to said dowel; wherein said plate and said dowel having complementary confronting recesses formed therein in which to receive keying means to cause said plate to rotate in common with said dowel.

8. A latching device, according to claim 7, further including:

keying means interpositionally engaged with said confronting recesses; and said keying means comprises a drive screw.

9. A latching device, according to claim 8, wherein:

said plate has a walled void formed therein;

said drive screw is set in said void for contacting engagement with the wall of said void; and said drive screw is threadedly engaged with, and in penetration of, said dowel.

10. A latching device, according to claim 9, wherein:

said chassis has an arcuate cut-out, of a given, overall length, formed therein; and a portion of said drive screw nests in said cut-out to limit common rotation of said dowel and said plate to said overall length.

11. A latching device, according to claim 7, wherein:

said dowel has a recess engageable for rotating said dowel.

12. A latching device, comprising:

a latching assembly; and a chassis, having an axis, for supporting said latching assembly; wherein said latching assembly has an extensible and retractable latch, and said assembly is coupled to, and movable axially of said chassis (a) for retracting said latch inwardly, i.e. toward said chassis, upon movement of said assembly in a first, axial direction, and (b) for extending said latch outwardly, i.e. away from said chassis, upon assembly movement in a second, opposite, axial direction;

said assembly having wing means manipulative for causing axial movement of said latching assembly; and camming means, journalled in said chassis, and having an extended limb engageable with said wing means for manipulating the latter to cause axial movement of said latching assembly;

wherein said camming means comprises a dowel, journalled in said chassis, and a cam plate coupled to said dowel;

said cam plate has said extended limb formed thereon;

said cam plate and said dowel have complementary, confronting recesses formed therein, in which to receive keying means to cause said plate to rotate in common with said dowel; and keying means interpositionally and replaceably engaged with said recesses.

* * * * *